United States Patent [19]

Arakawa et al.

[11] Patent Number: 4,501,683

[45] Date of Patent: Feb. 26, 1985

[54] RADIATION IMAGE STORAGE PANEL

[75] Inventors: Satoshi Arakawa; Junji Miyahara, both of Kaisei, Japan

[73] Assignee: Fuji Photo Film Co., Ltd., Kanagawa, Japan

[21] Appl. No.: 528,251

[22] Filed: Aug. 31, 1983

[30] Foreign Application Priority Data

Sep. 1, 1982 [JP] Japan ..... 57-150740

[51] Int. Cl.[3] ..... G03C 5/16

[52] U.S. Cl. ..... 252/301.26; 250/327.2; 250/483.1; 250/484.1; 250/486.1; 427/157

[58] Field of Search ..... 250/327.2, 483.1, 484.1, 250/486.1; 252/301.36; 427/157

[56] References Cited

U.S. PATENT DOCUMENTS

| | | | |
|---|---|---|---|
| 3,975,637 | 8/1976 | Ikedo et al. | 250/327.2 |
| 4,239,968 | 12/1980 | Kotera et al. | 250/327.2 |
| 4,368,390 | 1/1983 | Takahashi et al. | 250/327.2 |
| 4,380,702 | 4/1983 | Takahashi et al. | 250/327.2 |
| 4,394,581 | 7/1983 | Takahashi et al. | 250/327.2 |

*Primary Examiner*—Arthur P. Demers

*Attorney, Agent, or Firm*—Gerald J. Ferguson, Jr.; Joseph J. Baker

[57] ABSTRACT

A radiation image storage panel comprising a support, a phosphor layer provided thereon which comprises a binder and stimulable phosphor particles dispersed therein, and a protective film provided on said phosphor layer, characterized in that said protective film has a haze value within the range of 4–40%.

7 Claims, 1 Drawing Figure

RADIATION IMAGE STORAGE PANEL

BACKGROUND OF THE INVENTION

1. Field of the Invention

This invention relates to a radiation image storage panel, and more particularly relates to a radiation image storage panel comprising a support, a phosphor layer provided thereon which comprises a binder and stimulable phosphor particles dispersed therein, and a protective film provided on the phosphor layer.

2. Description of Prior Arts

For obtaining a radiation image, there has been conventionally employed a radiography utilizing a combination of a radiographic film having an emulsion layer containing a silver salt sensitive material and an intensifying screen.

As a method replacing the above-described radiography, a radiation image recording and reproducing method utilizing a stimulable phosphor as described, for instance, in U.S. Pat. No. 4,239,968, is recently paid much attention. In the radiation image recording and reproducing method, a radiation image storage panel comprising a stimulable phosphor (a stimulable phosphor sheet) is used, and the method involves steps of causing the stimulable phosphor of the panel to absorb a radiation energy having passed through an object or having radiated by an object; exciting the stimulable phosphor with an electromagnetic wave such as visible light and infrared rays (hereinafter referred to as "stimulating rays") to sequentially release the radiation energy stored in the stimulable phosphor as light emission; photo-electrically processing the emitted light to give an electric signal; and reproducing the electric signal as a visible image on a recording material such as a radiographic film or on a recording apparatus such as CRT.

In the above-described radiation image recording and reproducing method, a radiation image can be obtained with a sufficient amount of information by applying a radiation to the object at considerably smaller dose, as compared with the case of using the conventional radiography. Accordingly, this radiation image recording and reproducing method is of great value especially when the method is used for medical diagnosis.

The radiation image storage panel employed in the above-described radiation image recording and reproducing method has a basic structure comprising a support and a phosphor layer provided on one surface of the support. Further, a transparent film is generally provided on the free surface (surface not facing the support) of the phosphor layer to keep the phosphor layer from chemical deterioration or physical shock.

The phosphor layer comprises a binder and stimulable phosphor particles dispersed therein. When excited with stimulating rays after having been exposed to a radiation such as X-rays, the stimulable phosphor particles emit light (stimulated emission). Accordingly, the radiation having passed through an object or having radiated by an object is absorbed by the phosphor layer of the radiation image storage panel in proportion to the applied radiation dose, and a radiation image of the object is produced in the radiation image storage panel in the form of a radiation energy-stored imagea (a latent image). The radiation energy-stored image can be released as stimulated emission (light emission) by applying stimulating rays to the panel. The stimulated emission is photo-electrically processed to convert to electric signals, so as to produce a visible image from the radiation energy-stored image.

It is desired for the radiation image storage panel employed in the radiation image recording and reproducing method to have a high sensitivity and to provide an image of high quality (shapness, graininess, etd.) As described hereinbefore, the radiation image storage panel generally has a protective film to keep the phosphor layer from chemical deterioration or physical shock. As the protective film provided on the phosphor layer, a film having very high optical transparency is proposed in order to obtain an image of high quality without lowering of the image sharpness. Examples of such highly transparent protective film materials include a variety of plastic films available in the market which have a haze value [defined in JIS (Japanese Industrial Standard) K 6714] within the range of 2–3%.

In a radiation image obtained upon exciting the radiation image storage panel with stimulating rays after exposure to a radiation such as X-rays, certain shaded portions are sometimes observed in addition to the desired radiation image of the object, resulting in production of an image having unevenness in optical density. In an extreme case, certain visible line patterns are produced in the resulting image. As a light source of stimulating rays, a laser beam showing a high beam convergence is generally employed, and in the case of using the laser beam, the unevenness in optical density is particularly frequently observed. The unevenness in optical density of image causes troubles in analysis of the image, which resulting in lowering of quality and amount of information on the object.

SUMMARY OF THE INVENTION

An object of the present invention is to provide a radiation image storage panel which provides an image free from unevenness in optical density.

In particularly, an object of the present invention is to provide a radiation image storage panel which provides an image free from unevenness in optical density with only slight reduction of the sharpness of the image.

The above-described objects are accomplished by the radiation image storage panel of the present invention comprising a support, a phosphor layer provided thereon which comprises a binder and stimulable phosphor particles dispersed therein, and a protective film provided on the phosphor layer, characterized in that said protective film has a haze value within the range of 4–40%.

In this invention, a haze value means a value defined in JIS (Japanese Industrial Standard) K 6714 and is expressed by a ratio of a transmittance of scattered light to a transmittance of whole light in terms of percent (%).

DETAILED DESCRIPTION OF THE INVENTION

Figure 1:
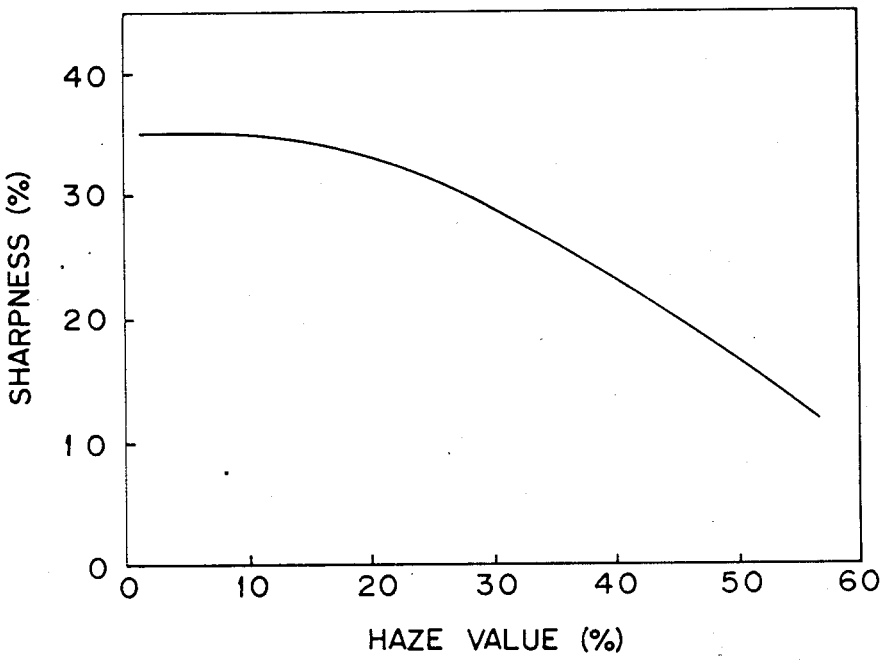
FIG. 1 shows a relationship between a haze value of a protective film of a radiation image storage panel and sharpness of the image given using the panel.

A protective film of a radiation image storage panel is generally formed on a phosphor layer thereof by applying a coating solution of a transparent polymer in an appropriate solvent thereonto, or causing a transparent film to adhere to the phosphor layer using an adhesive agent.

According to the studies of the present inventors, the protective film is apt to be formed uneven in the density whereby causing lack of optical uniformity within the film layer, or the film is likely formed partly uneven in the thickness, and the unevenness in optical density of image is mainly caused by said unevenness of the properties of the protective film. In the case of using a laser beam as a light source of stimulating rays for obtaining stimulated emission, it is thought that interference fringes of the laser beam (it is known the laser beam is highly coherent) caused by unevenness in density or in thickness of the protective film appear on the resulting image as unevenness in optical density.

According to the further studies of the inventors, the unevenness in optical density of image can be effectively prevented by employing a film having a haze value within the range of 4–40% as a protective film of the radiation image storage panel, as described hereinbefore. In other words, the employment of the protective film in which the transparency is decreased to the specific range can effectively prevent the formation of image having unevenness in optical density with only slight reduction of the sharpness of the image.

The radiation image storage panel of the present invention having the above-described preferable characteristics can be prepared by a process comprising steps of forming a phosphor layer on a support, and subsequently forming or providing a desired protective film on the formed phosphor layer. A representative process for the preparation of the radiation image storage panel of the present invention will be described below.

The support material employed in the present invention can be chosen from those employed in the conventional radiographic intensifying screens. Examples of the support material include plastic films such as films of cellulose acetate, polyester, polyethylene terephthalate, polyamide, polyimide, triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From a viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high sharpness type radiation image storage panel, while the latter is appropriate for preparing a high sensitive type radiation image storage panel.

In the preparation of a known radiation image storage panel, one or more additional layers are occasionally provided between the support and the phosphor layer to enhance the adhesion between the support and the phosphor layer, or to improve the sensitivity of the panel or the quality of the image provided thereby. For instance, a subbing layer or an adhesive layer may be provided by coating a polymer material such as gelatin over the surface of the support on the phosphor layer side. Otherwise, a light-reflecting layer or a light-absorbing layer may be provided by providing a polymer material layer containing a light-reflecting material such as titanium dioxide or a light-absorbing material such as carbon black. In the present invention, one or more of these additional layers may be provided depending on the type of the radiation image storage panel under preparation.

As described in Japanese Patent Application No. 57(1982)-82431 filed by the present applicant, the phosphor layer side surface of the support (or the surface of an adhesive layer, light-reflecting layer, or light-absorbing layer in the case where such layers provided on the phosphor layer) may be provided with protruded and depressed portions for enhancement of the sharpness of the image obtained.

On the above-mentioned support, a phosphor layer is provided. The phosphor layer comprises a binder and stimulable phosphor particles dispersed therein.

The stimulable phosphor particles, as described hereinbefore, give stimulated emission when excited by stimulating rays after exposure to a radiation. In the viewpoint of practical use, the stimulable phosphor is desired to give stimulated emission in the wavelength region of 300–500 nm when excited by stimulating rays in the wavelength region of 400–850 nm.

Examples of the stimulable phosphor employable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaOxAl_2O_3$:Eu, in which x is a number satisfying the condition of $0.8 \leqq x \leqq 10$, and $M^{2+}OxSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,326,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078; and $(Ba_{1-x},M^{2+}{}_x)FX:yA$, in which $M^{2+}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions $0 \leqq x \leqq 0.6$ and $0 \leqq y \leqq 0.2$, respectively, as described in Japanese Patent Provisional Publication No. 55(1980)-12145.

The above-described stimulable phosphor are given by no means to restrict the stimulable phosphor employable in the present invention. Any other phosphors can be also employed, provided that the phosphor gives stimulated emission when excited by stimulating rays after exposure to a radiation.

Examples of the binder to be comprised in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polymethyl methacrylate, vinyl chloride-vinyl acetate copoymer, polyurethane, cellulose acetate butyrate, polyvinyl alcohol, and linear polyester. Particularly preferred are nitrocellulose, linear polyester, and a mixture of nitrocellulose and linear polyester.

The phosphor layer can be formed on the support, for instance, by the following procedure.

In the first place, phosphor particles and a binder are added to an appropriate solvent, and these are then mixed to prepare a coating dispersion of the phosphor particles in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids, such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the phosphor in the coating dispersion may be determined according to the characteristics of the aimed radiation image storage panel and the nature of the phosphor employed. Generally, the ratio therebetween is within the range of from 1:1 to 1:100 (binder:phosphor, by weight), preferably from 1:8 to 1:40.

The coating dispersion may contain a dispersing agent to assist the dispersibility of the phosphor particles therein, and also contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as above is applied evenly onto the surface of the support to form a layer of the coating dispersion. The coating procedure can be carried out by a conventional method such as a method using a doctor blade, a roll coater or a knife coater.

After applying the coating dispersion to the support, the coating dispersion is then heated slowly to dryness so as to complete the formation of a phosphor layer. The thickness of the phosphor layer varies depending upon the characteristics of the aimed radiation image storage panel, the nature of the phosphor, the ratio between the binder and the phosphor, etc. Generally, the thickness of the phosphor layer is within the range of from 20 μm to 1 mm, preferably from 50 to 500 μm.

The phosphor layer can be provided on the support by the methods other than that given in the above. For instance, the phosphor layer is initially prepared on a sheet (false support) suchas a glass plate, a metal plate or a plastic sheet using the aforementioned coating dispersion and then thus prepared phosphor layer is overlaid on the genuine support under pressure or using an adhesive agent.

The protective film employed in the present invention having a haze value within the range of 4–40% is provided on the free surface of the phosphor layer (the surface not facing the support).

The protective film having the specific haze value can be prepared, for example, by a process comprising steps of forming a film of transparent polymer, and subjecting the surface of the film to roughing processing so as to give a haze value within the specific range. The preparation of the protective film and the provision thereof on the phosphor layer can be carried out at the same time or through separate procedures.

Examples of the methods for the preparation of the protective film and the provision thereof on the phosphor layer are as follows:

(1) a method involving steps of coating the surface of the phosphor layer with a solution prepared by dissolving in an appropriate solvent a transparent polymer such as a cellulose derivative (e.g. cellulose acetate or nitrocellulose) or a synthetic polymer (e.g. polymethyl methacrylate, polyvinyl butyral, polyvinyl formal, polycarbonate, polyvinyl acetate or vinyl chloride-vinyl acetate copolymer), drying the coated solution to prepare a protective film, and then subjecting the surface of the prepared film to roughing processing so as to reduce the transparency of the film to a value within the specific range, that is, a method involving steps of directly forming a transparent protective film on the phosphor layer and subsequently adjusting the haze value of the transparent protective film;

(2) a method involving steps of preparing a transparent film from a polymer such as polyethylene terephthalate, polyethylene, polyvinylidene chloride or polyamide, subjecting the surface of the transparent film to roughing processing, and then fixing the film to the surface of the phosphor layer with an appropriate adhesive agent, that is, a method of preparing a transparent protective film, adjusting the haze value of the film and subsequently providing the protective film onto the phosphor layer; and (3) a method according to the above-described method (2) except that the adjustment of haze value is made on a transparent protective film previously provided onto the phosphor layer.

There is no specific limitation on the materials employable for the preparation of the protective film, as far as the resulting protective film can be adjusted to have a haze value within the range defined in the present invention. Generally, the material is chosen from those employed or proposed as materials of the protective film of the known radiation image storage panels or the conventional radiographic intensifying screens. From the viewpoint of characteristics of radiation image storage panel as an information recording material and easiness in handling, polyethylene terephthalate is a particularly preferable material for the protective film in the present invention.

The adjustment of the haze value of a protective film can be made in an optionally chosen manner. As a practically effective method, there can be mentioned surface roughing processing which comprises subjecting the surface of the protective film to sand blasting or the like to produce a matt surface thereon.

Generally, the protective film in the present invention having a haze value in the specific range is prepared, as described hereinbefore, by beforehand forming a protective film and then subjecting the film to a processing for adjusting the haze value. However, there can employed various methods, such as, a method of incorporating an appropriate opaque material into a protective film, as well as a method of accomplishing both the formation of a protective layer and the adjustment of the haze value in a single procedurer, under controlling the conditions of procedures for the formation of a protective film.

As described hereinbefore, the protective film in the present invention has a haze value within the range of 4–40% (a value according to the definition in JIS K 6714), and a particularly preferable range is 8–20% from the viewpoints of attaining complete prevention of formation of an image having unevenness in optical density and reducing decrease of the sharpness of the resulting image as low as possible.

The transparent protective film prepared in the manner as above preferably has a thickness within the range of 1–100 μm, and more preferably within the range of 3–50 μm, in view of image characteristics such as sharpness as well as strength of the film.

The following examples and comparison exmaples further illustrate the present invention, but these examples are by no means understood to restrict the present invention.

EXAMPLE 1

To a mixture of a particulated europium activated barium fluorobromide stimulable phosphor (BaFBr:Eu) and a linear polyester resin were added successively methyl ethyl ketone and nitrocellulose (nitrofication degree: 11.5%), to prepare a dispersion containing the phosphor particles. Subsequently, tricresyl phosphate, n-butanol and methyl ethyl ketone were added to the resulting dispersion. The mixture was sufficiently stirred by means of a propeller agitater to obtain a homogeneous coating dispersion having a viscosity of 25–35 PS (at 25° C.).

The coating dispersion was applied to a polyethylene terephthalate sheet containing carbon black (support, thickness: 250 μm) placed horizontally on a glass plate. The application of the coating dispersion was carried out using a doctor blade. The support having a layer of the coating dispersion was then placed in an oven and heated at a temperature gradually rising from 25° to 100° C. Thus, a phosphor layer having thickness of 300 μm was formed on the support.

On the phosphor layer was placed a polyethylene terephthalate film having a haze value of 4.0% (thickness: 12 μm; provided with a polyester adhesive layer on one surface; available in the market) to combine the film and the phosphor layer with the adhesive layer.

Thus, a radiation image storage panel consisting essentially of a support, a phosphor layer and a protective film was prepared.

EXAMPLE 2

The procedure of Example 1 was repeated except that a polyethylene terephthalate film having a haze value of 5.1% (thickness: 12 μm; available in the market) was employed as a protective film, to prepare a radiation image storage panel consisting essentially of a support, a phosphor layer and a protective film.

EXAMPLE 3

The procedure of Example 1 was repeated except that a polyethylene terephthalate film having a haze value of 6.8% (thickness: 12 μm; available in the market) was employed as a protective film, to prepare a radiation image storage panel consisting essentially of a support, a phosphor layer and a protective film.

EXAMPLE 4

The procedure of Example 1 was repeated except that a polyethylene terephthalate film having a haze value of 10.2% (thickness: 12 μm; available in the market) was employed as a protective film, to prepare a radiation image storage panel consisting essentially of a support, a phosphor layer and a protective film.

EXAMPLE 5

The procedure of Example 1 was repeated except that a polyethylene terephthalate film whose one surface (surface not facing the phosphor layer) had been subjected to sand blasting to have a haze value of 12.0% was employed as a protective film, to prepare a radiation image storage panel consisting essentially of a support, a phosphor layer and a protective film.

EXAMPLE 6

The procedure of Example 1 was repeated except that a polyethylene terephthalate film whose one surface (surface not facing the phosphor layer) had been subjected to sand blasting to have a haze value of 17.5% was employed as a protective film, to prepare a radiation image storage panel consisting essentially of a support, a phosphor layer and a protective film.

EXAMPLE 7

The procedure of Example 1 was repeated except that a polyethylene terephthalate film whose one surface (surface not facing the phosphor layer) had been subjected to sand blasting to have a haze value of 20.3% was employed as a protective film, to prepare a radiation image storage panel consisting essentially of a support, a phosphor layer and a protective film.

EXAMPLE 8

The procedure of Example 1 was repeated except that a polyethylene terephthalate film whose one surface (surface not facing the phosphor layer) had been subjected to sand blasting to have a haze value of 24.7% was employed as a protective film, to prepare a radiation image storage panel consisting essentially of a support, a phosphor layer and a protective film.

EXAMPLE 9

The procedure of Example 1 was repeated except that a polyethylene terephthalate film whose one surface (surface not facing the phosphor layer) had been subjected to sand blasting to have a haze value of 27.5% was employed as a protective film, to prepare a radiation image storage panel consisting essentially of a support, a phosphor layer and a protective film.

EXAMPLE 10

The procedure of Example 1 was repeated except that a polyethylene terephthalate film whose one surface (surface not facing the phosphor layer) had been subjected to sand blasting to have a haze value of 38.0% was employed as a protective film, to prepare a radiation image storage panel consisting essentially of a support, a phosphor layer and a protective film.

COMPARISON EXAMPLE 1

The procedure of Example 1 was repeated except that a polyethylene terephthalate film having a haze value of 2.2% (thickness: 12 μm; available in the market) was employed as a protective film, to prepare a radiation image storage panel consisting essentially of a support, a phosphor layer and a protective film.

COMPARISON EXAMPLE 2

The procedure of Example 1 was repeated except that a polyethylene terephthalate film having a haze value of 3.0% (thickness: 12 μm; available in the market) was employed as a protective film, to prepare a radiation image storage panel consisting essentially of a support, a phosphor layer and a protective film.

COMPARISON EXAMPLE 3

The procedure of Example 1 was repeated except that a polyethylene terephthalate film whose one surface (surface not facing the phosphor layer had been subjected to sand blasting to have a haze value of 50.2% was employed as a protective film, to prepare a radiation image storage panel consisting essentially of a support, a phosphor layer and a protective film.

COMPARISON EXAMPLE 4

The procedure of Example 1 was repeated except that a polyethylene terephthalate film whose one surface (surface not facing the phosphor layer) had been subjected to sand blasting to have a haze value of 57.4% was employed as a protective film, to prepare a radiation image storage panel consisting essentially of a support, a phosphor layer and a protective film.

The radiation image storage panels prepared in the manner as above were evaluated on the sharpness of image and the unevenness in optical density of image. The evaluation methods are given below:

(1) Sharpness of Image

The radiation image storage panel was exposed to X-rays of 80 KVp through an MTF chart and subsequently was scanned with a He-Ne laser beam (wavelength: 632.8 nm) to stimulate the phosphor particles. The light emitted by the phosphor layer of the panel was detected and converted to the corresponding electric signal by means of a photosensor (a photomultiplier having spectral sensitivity of type S-5). The electric signal was reproduced by an image reproducing apparatus to obtain a visible image on a recording apparatus, and the modulation transfer function (MTF) value of the visible image was determined. The MTF value was given as a value (%) at the spacial frequency of 2 cycle/mm.

(2) Unevenness in Optical Density of Image

The radiation image storage panel was exposed to X-rays of 80 KVp and subsequently was scanned with a He-Ne laser beam (wavelength: 632.8 nm) to stimulate the phosphor particles. The light emitted by the phosphor layer of the panel was detected and converted to the corresponding electric signal by means of a photosensor (a photolmultiplier having spectral sensitivity of type S-5). The electric signal was reproduced by an image reproducing apparatus to obtain a visible image on a recording apparatus. The resulting image was observed with eyes to judge the appearance of unevenness in optical density of image.

The results of the evalutions on the radiation image storage panels are set for in Table 1.

TABLE 1

| | Haze Value (%) | Sharpness of Image (%) | Unevenness in Optical Density of Image |
|---|---|---|---|
| Example 1 | 4.0 | 35 | none |
| Example 2 | 5.1 | 35 | none |
| Example 3 | 6.8 | 34 | none |
| Example 4 | 10.2 | 34 | none |
| Example 5 | 12.0 | 35 | none |
| Example 6 | 17.5 | 33 | none |
| Example 7 | 20.3 | 33 | none |
| Example 8 | 24.7 | 30 | none |
| Example 9 | 27.5 | 29 | none |
| Example 10 | 38.0 | 25 | none |
| Com. Example 1 | 2.2 | 35 | observed |
| Com. Example 2 | 3.0 | 34 | observed |
| Com. Example 3 | 50.2 | 15 | none |
| Com. Example 4 | 57.4 | 14 | none |

The results on the sharpness of image given in the use of these radiation image storage panels under the above-described evaluation procedure are illustrated graphically in FIG. 1.

That is, FIG. 1 shows a relationship between a haze value of a protective film of the radiation image storage panel and the sharpness of image obtained given using the panel.

We claim:

1. A radiation image storage panel comprising a support, a phosphor layer provided thereon which comprises a binder and stimulable phosphor particles dispersed therein, and a protective film provided on said phosphor layer, characterized in that said protective film has a haze value within the range of 4–40%.

2. The radiation image storage panel as claimed in claim 1, in which the protective film has a haze value within the range of 8–20%.

3. The radiation image storage panel as claimed in claim 1 or 2, in which the protective film has a thickness within the range of 1–100 μm.

4. The radiation image storage panel as claimed in claim 3, in which the protective film has a thickness within the range of 3–50 μm.

5. The radiation image storage panel as claimed in claim 1 or 2, in which the protective film is made of polyethylene terephthalate.

6. The radiation image storage panel as claimed in claim 3, in which the protective film is made of polyethylene terephthalate.

7. The radiation image storage panel as claimed in claim 4, in which the protective film is made of polyethylene terephthalate.

* * * * *